US009883746B2

(12) United States Patent
Piretti

(10) Patent No.: US 9,883,746 B2
(45) Date of Patent: Feb. 6, 2018

(54) CHAIR WITH SEAT AND BACKREST MOVABLE IN A SYNCHRONIZED WAY

(71) Applicant: PRO-CORD S.p.A., Bologna (IT)

(72) Inventor: Alessandro Piretti, Bologna (IT)

(73) Assignee: PRO-CORD S.P.A., Bologna (IT)

( * ) Notice: Subject to any disclaimer, the term of this patent is extended or adjusted under 35 U.S.C. 154(b) by 24 days.

(21) Appl. No.: 15/097,910

(22) Filed: Apr. 13, 2016

(65) Prior Publication Data

US 2016/0220025 A1 Aug. 4, 2016

Related U.S. Application Data

(63) Continuation-in-part of application No. 14/937,615, filed on Nov. 10, 2015.

(30) Foreign Application Priority Data

Nov. 11, 2014 (IT) ..... TO2014A0936

(51) Int. Cl.
*A47C 1/024* (2006.01)
*A47C 1/032* (2006.01)

(52) U.S. Cl.
CPC ..... *A47C 1/03261* (2013.01); *A47C 1/03238* (2013.01); *A47C 1/03255* (2013.01); *A47C 1/03277* (2013.01)

(58) Field of Classification Search
CPC . A47C 1/03261; A47C 1/03277; A47C 1/033; A47C 1/031; A47C 1/032; A47C 7/44; A47C 7/445

(Continued)

(56) References Cited

U.S. PATENT DOCUMENTS 293,813 A * 2/1884 St. John ..... A47C 3/021 297/296
300,228 A * 6/1884 De Pew ..... A47C 3/021 297/300.1

(Continued)

FOREIGN PATENT DOCUMENTS

EP 0249584 A2 12/1987
JP 2013132403 A 7/2013
WO 2009039231 A1 3/2009

OTHER PUBLICATIONS

Italian search report and written opinion for application No. TO2014A000936 dated Jun. 17, 2015.

*Primary Examiner* — Jose V Chen
(74) *Attorney, Agent, or Firm* — Patterson & Sheridan, LLP

(57) ABSTRACT

A chair comprising a base structure comprising a support, a seat connected to the support via a synchronization mechanism and movable with respect to the base structure between a lowered position and a raised position, and a backrest connected to the synchronization mechanism and movable between an upright position, corresponding to the lowered position of the seat, and a backward-inclined position corresponding to the raised position of the seat, wherein the synchronization mechanism comprises two loop-shaped elastic elements spaced apart in a transverse direction and each comprising a lower portion fixed to a rigid support, an upper portion fixed to the seat, a front elastic portion and an essentially C-shaped rear elastic portion that connect the upper portion to the lower portion, wherein the backrest is fixed to the rear elastic portions of the loop-shaped elastic elements.

13 Claims, 13 Drawing Sheets

(58) Field of Classification Search
USPC ..... 297/300.1, 300.4, 300.6, 300.2, 301.1, 297/301.3, 301.5, 302.1, 302.3, 302.5
See application file for complete search history.

(56) References Cited

U.S. PATENT DOCUMENTS 2,616,483 A * 11/1952 Jensen ..... A47C 17/175 297/300.1
4,575,150 A * 3/1986 Smith ..... A47C 1/03255 248/624
4,889,385 A * 12/1989 Chadwick ..... A47C 3/026 297/285
4,911,501 A * 3/1990 Decker ..... A47C 1/03255 297/285
5,080,318 A * 1/1992 Takamatsu ..... A47C 3/026 248/598
5,971,481 A * 10/1999 Emmenegger ..... A47C 1/03238 297/300.4
6,523,895 B1 * 2/2003 Vogtherr ..... A47C 1/024 297/291
6,609,755 B2 * 8/2003 Koepke ..... A47C 1/03255 297/300.1
8,029,060 B2 * 10/2011 Parker ..... A47C 1/023 297/300.1
9,173,492 B1 * 11/2015 Fortin ..... A47C 1/14
2002/0109384 A1 * 8/2002 Hansen ..... A47C 1/03255 297/300.1
2003/0184140 A1 * 10/2003 Bruske ..... A47C 1/03261 297/316
2004/0075321 A1 * 4/2004 Sangiorgio ..... A47C 1/03255 297/300.1
2004/0119325 A1 * 6/2004 Goodworth ..... A47C 3/026 297/301.1
2006/0175884 A1 * 8/2006 Jenkins ..... A47C 3/026 297/300.4
2012/0025574 A1 * 2/2012 Wilkinson ..... A47C 1/03 297/300.1
2013/0169017 A1 * 7/2013 Masunaga ..... A47C 1/03255 297/320
2015/0223605 A1 * 8/2015 Piretti ..... A47C 1/03261 297/341
2016/0128481 A1 * 5/2016 Piretti ..... A47C 1/03261 297/300.1

* cited by examiner

CHAIR WITH SEAT AND BACKREST MOVABLE IN A SYNCHRONIZED WAY

CROSS-REFERENCE TO RELATED APPLICATIONS

The present application is a continuation-in-part of U.S. patent application Ser. No. 14/937,615, filed on Nov. 10, 2015, which claims priority to Italian Patent Application No. TO2014A000936, filed on Nov. 11, 2014, the contents of each application are herein incorporated by reference.

BACKGROUND OF THE INVENTION

Field of the Invention

The present invention relates to a chair with seat and backrest movable in a synchronized way.

More precisely, the invention relates to a chair in which the seat is movable between a lowered position and a raised position and the backrest is movable between an upright position corresponding to the lowered position of the seat and a backward-inclined position corresponding to the raised position of the seat.

In seats of this type, the resistance opposed by the backrest against the movement of backward inclination is proportional to the weight of the user. Mechanisms of this type are usually known as "weight-activated".

Description of Prior Art

One of the first "weight-activated" mechanisms is described in the document EP-A-0249584 by the same Applicant, which describes a chair in which the seat is connected to the support structure by means of at least one parallelogram mechanism comprising two rods whose ends are articulated to the seat and to the support structure, so as to allow a movement of the seat between a lowered position and a raised position. The backrest has a support structure which oscillates between an upright position, corresponding to the lowered position of the seat, and a backward-inclined position, corresponding to the raised position of the seat. The support structure of the seat is rigidly connected to one of the rods of the parallelogram mechanism. The parallelogram mechanism is equipped with elastic elements to push the backrest towards its upright position.

The main drawback of chairs equipped with parallelogram mechanisms with articulated rods is the high complexity due to the high number of components.

WO2009/039231 (Herman Miller, Inc.) describes a chair with a deformable seat and backrest, which adapts to the user's weight. This chair comprises two side profiles between which a flexible material is stretched, forming the support surfaces of the seat and the backrest. Each of the two side profiles is formed of an integral element of plastic material with two beam elements connected together by means of integral connecting elements.

This chair structure is specifically dedicated to chairs in which the support surface of the seat and the backrest is formed by a flexible sheet and is not easily adaptable to chairs with different configurations of the seat and backrest.

SUMMARY OF THE INVENTION

The present invention aims to provide a chair with seat and backrest movable in a synchronized way having a simple structure and easily adaptable to different configurations of the seat and backrest.

According to the present invention, this scope is achieved by a chair having the characteristics forming the subject of claim 1.

The claims form an integral part of the disclosure provided here in relation to the invention.

BRIEF DESCRIPTION OF THE DRAWINGS

The present invention will now be described in detail, with reference to the attached drawings, given purely by way of non-limiting example, wherein.

DETAILED DESCRIPTION

Figure 1:
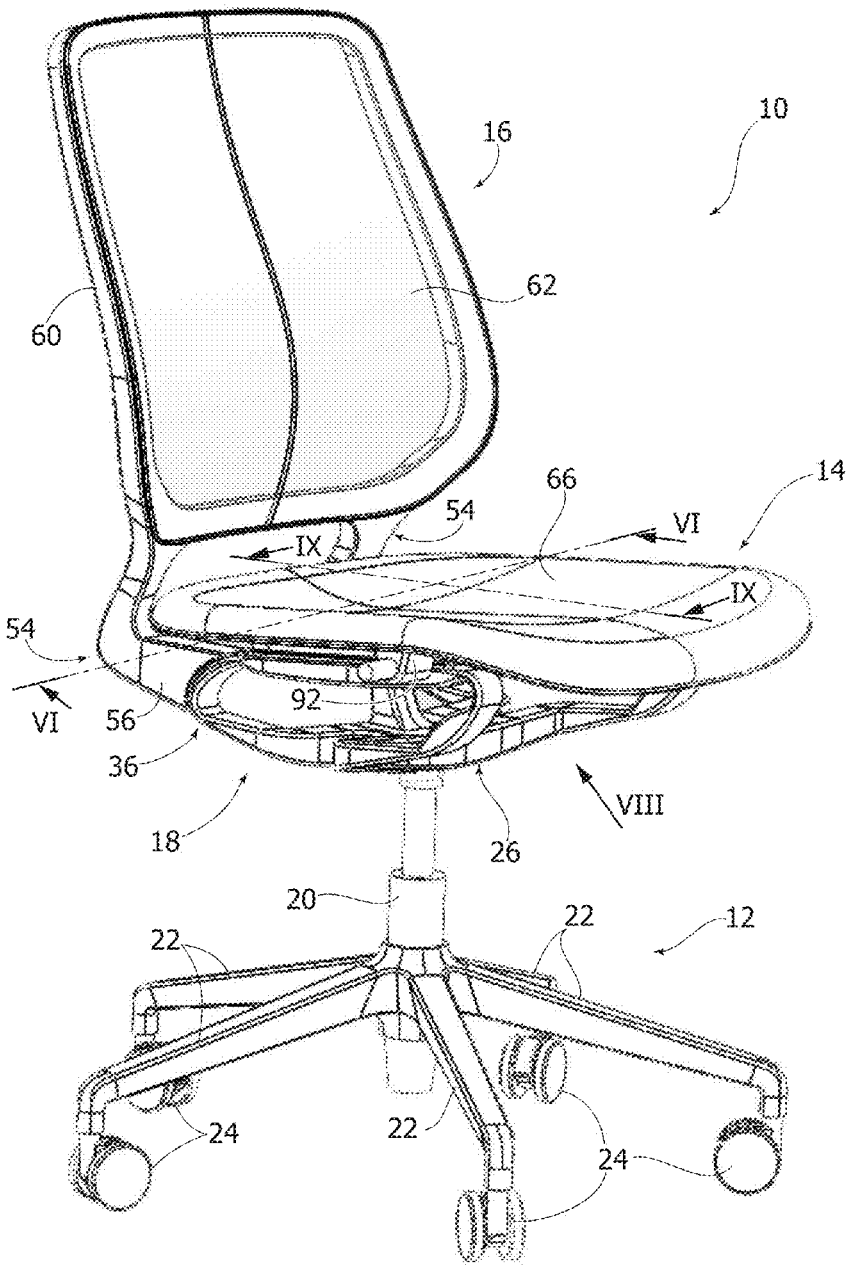
FIG. 1 is a perspective view of a chair according to the present invention.
Figure 2:
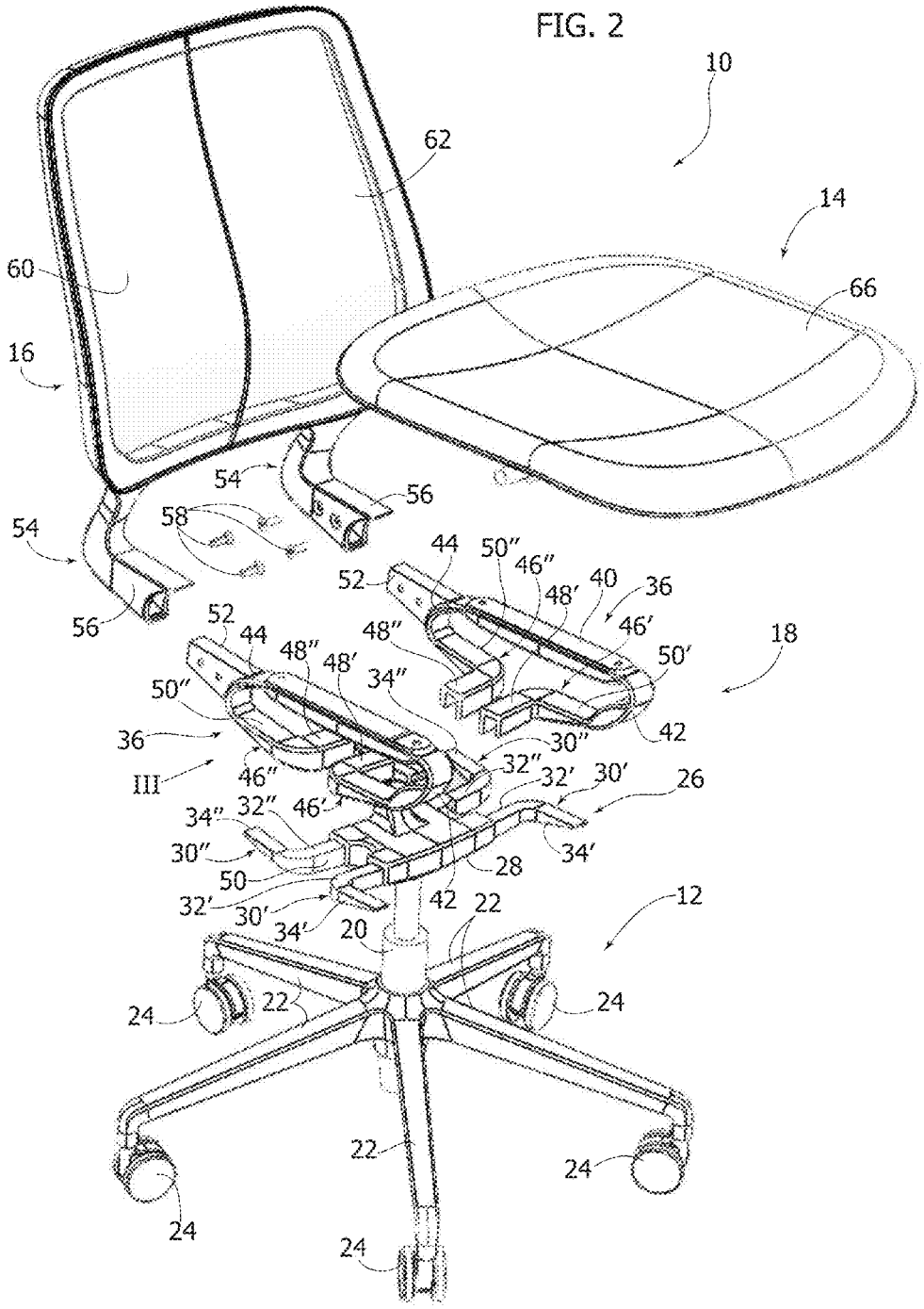
FIG. 2 is an exploded perspective view of the chair of FIG. 1.

With reference to FIGS. 1 and 2, numeral 10 indicates a chair according to an embodiment of the present invention. The chair 10 comprises a base structure 12, a seat 14 and a backrest 16. The chair 10 comprises a synchronization mechanism 18, which allows a synchronized movement of the seat 14 and the backrest 16 in the manner that will be described below.

In the embodiment illustrated by way of example in the figures, the base structure 12 comprises a rotatable and height-adjustable central column 20, connected to a plurality of radial arms 22 carrying respective pivoting wheels 24. The present invention is, however, not limited to a chair with a base structure of this type. The solution according to the present invention can also be applied to chairs with four legs or with a cantilever frame.

The synchronizing mechanism 18 comprises a support 26 fixed to the base structure 12. The support 26 can be formed of aluminum or any other rigid material. The support 26 comprises a central base 28 from which two front side arms 30' and two rear side arms 30" extend. The side arms 30', 30" protrude laterally outwards from the central base 28. The front and rear side arms 30', 30" have respective transverse portions 32', 32" and respective longitudinal portions 34', 34".

Figure 3:
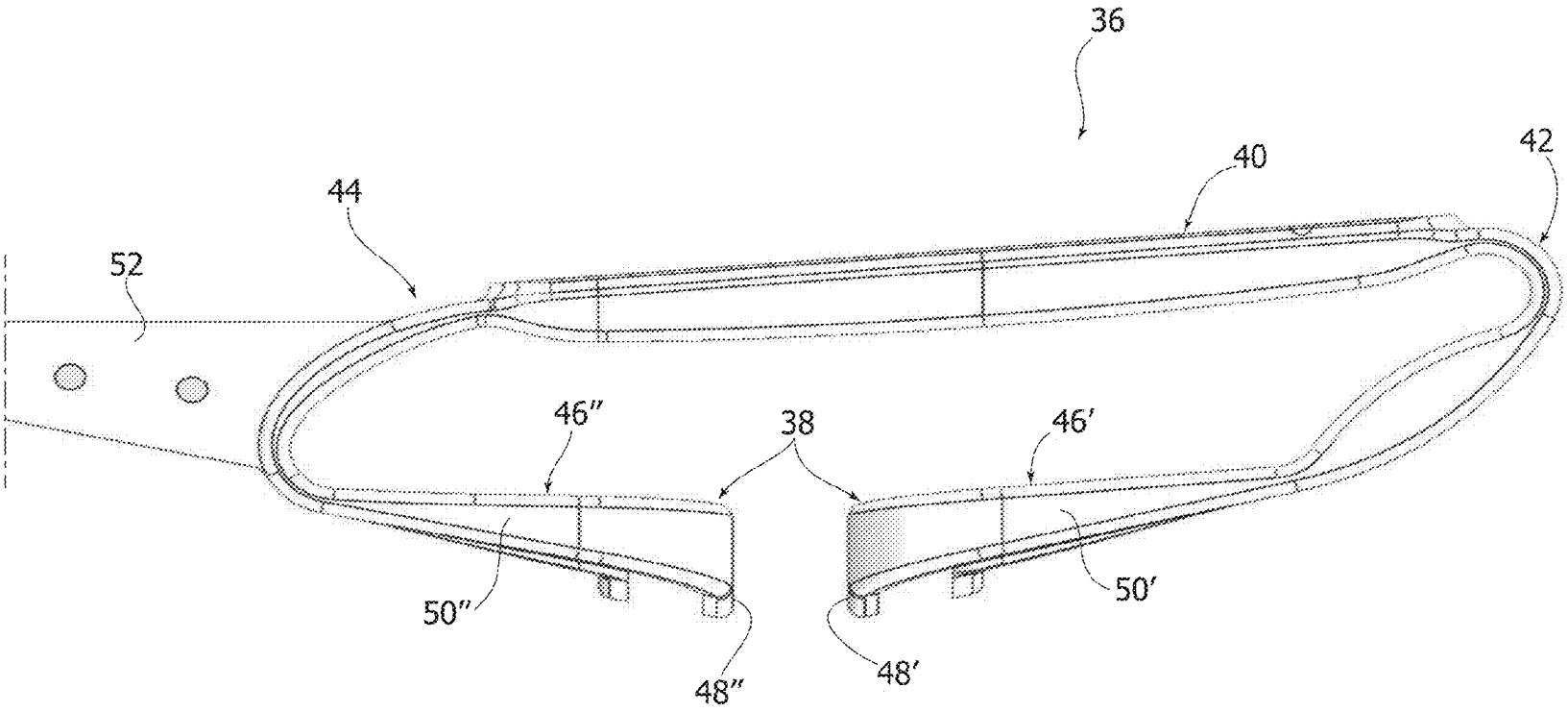
FIG. 3 is a side view of the element indicated by the arrow III in FIG. 2.

The synchronization mechanism 18 comprises two loop-shaped elastic elements 36 spaced apart in the transverse direction. With reference to FIG. 3, each loop-shaped elastic element 36 comprises a lower portion 38 fixed to the support 26, an upper portion 40 fixed to the seat 14, a front elastic portion 42 and a rear elastic portion 44. Each loop-shaped elastic element 36 is made from a single piece of molded plastic material. The lower portion 38 of each loop-shaped elastic element 36 comprises two fastening elements 46', 46", which are fixed to respective side arms 30', 30". In the illustrated example, each fastening element 46', 46' comprises a transverse portion 48', 48" and a longitudinal portion 50', 50".

The transverse portions 48', 48" engage respective transverse portions 32', 32" of the side arms 30', 30" and the longitudinal portions 50', 50" of the fastening elements 46', 46" engage respective longitudinal portions 34', 34" of the side arms 30', 30". Preferably, the fastening elements 46', 46" have a U-shaped cross-section and snap engage the respective side arms 30', 30".

The upper portion 40 of each loop-shaped elastic element 36 has the shape of a longitudinal rectilinear bar, parallel to the longitudinal portions 50', 50" of the respective fastening elements 46', 46".

The front elastic portion 42 has an upper end integrally connected to a front end of the upper portion 40 and a lower end integrally connected to a front end of the longitudinal portion 50'. The rear elastic portion 44 has an upper end integrally connected to a rear end of the upper portion 40 and a lower end integrally connected to a rear end of the longitudinal portion 50".

The rear elastic portion 44 of each loop-shaped elastic element 36 has a rear projection 52 integrally connected with the curved part of the rear elastic portion 44. The rear projection 52 extends in the longitudinal direction and protrudes rearward from the respective loop-shaped elastic element 36.

The rear projections 52 of the loop-shaped elastic elements 36 are fixed to respective L-shaped lower arms 54 of the backrest 16. In the illustrated example, the L-shaped lower arms 54 protrude downwards from a lower edge of the backrest 16 and have respective hollow horizontal portions 56 in which respective rear projections 52 are inserted. The rear projections 52 are fixed to respective arms 54 by transverse screws 58. In the example illustrated in the figures, the backrest 16 has a perimeter frame 60 of plastic material and the L-shaped lower arms 54 are integrally connected at their upper ends with the lower side of the frame 60. A sheet of flexible material 62, stretched over the frame 60, forms the support surface of the backrest 16. Alternatively, the backrest 16 could be formed of a shaped panel of plastic material. In an alternative embodiment, the backrest 16 (or the frame 60 of the backrest 16) could be integrally connected with the loop-shaped elastic elements 36.

The seat 14 comprises a seat support panel 64 and a padding 66 fixed on the upper surface of the seat support panel 64. The seat support panel 64 has two longitudinal rectilinear ribs 68 integrally formed on the lower surface of the seat support panel 64 and spaced apart in the transverse direction. The longitudinal rectilinear ribs 68 rest on the respective upper portions 40 of the loop-shaped elastic elements 36. The seat support panel 64 is fixed to the two upper portions 40 of the loop-shaped elastic elements 36, for example by means of screws (not illustrated).

Figure 6:
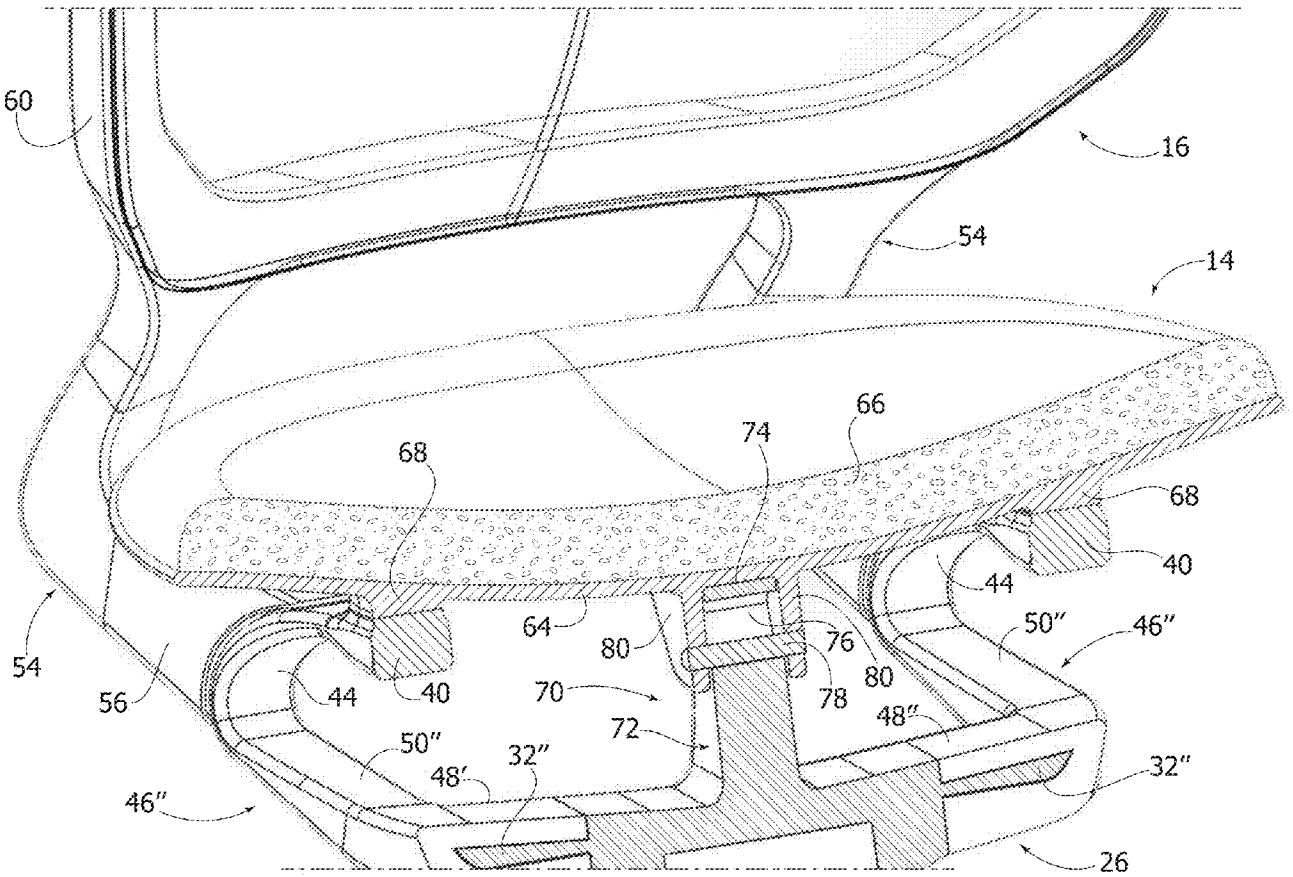
FIGS. 6 and 7 are cross-sections according to the line VI-VI of FIG. 1, in the rest position and in the position of maximum backward inclination, respectively.
Figure 7:
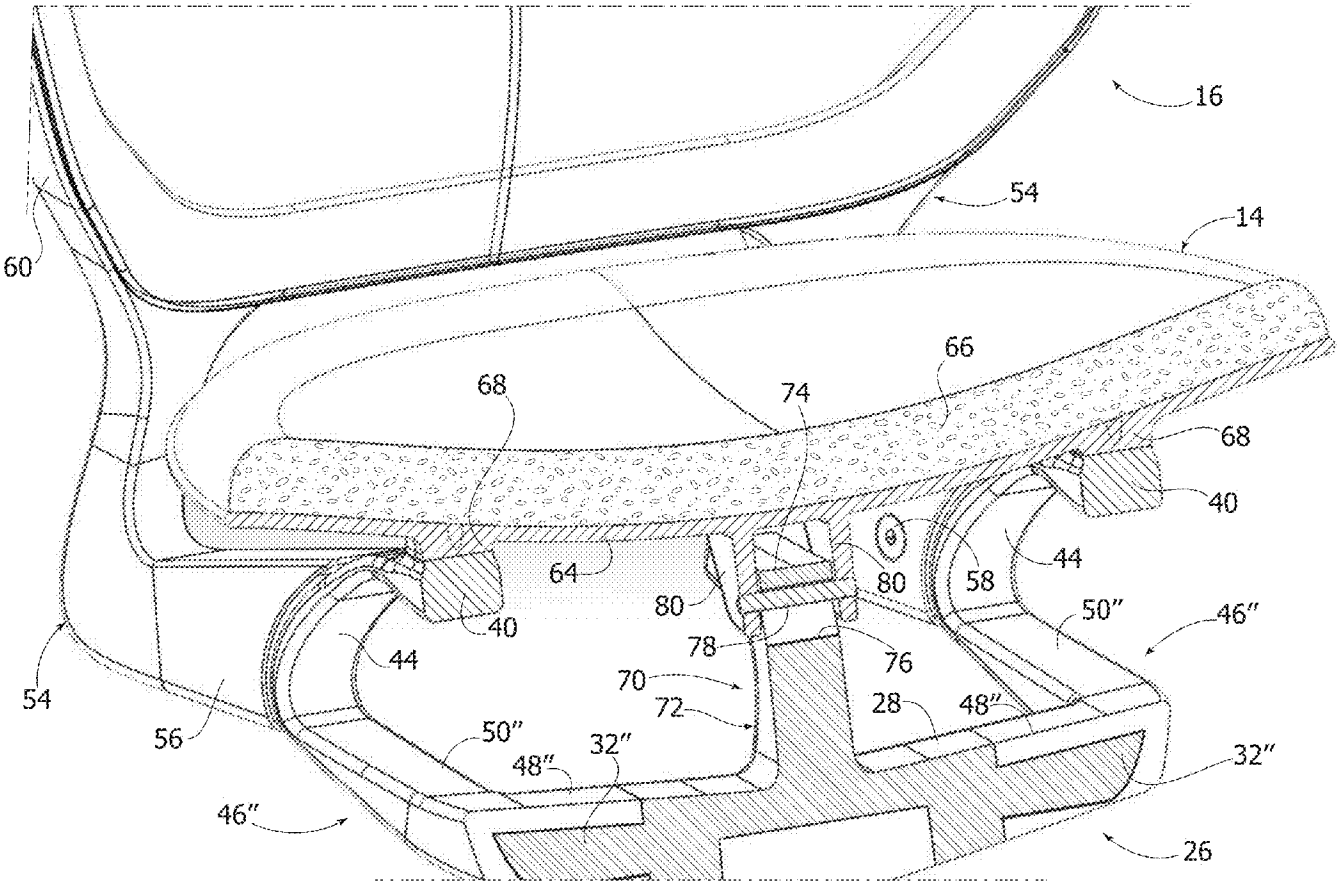

With reference to FIGS. 6 and 7, the chair 10 comprises a limit stop device 70 operatively arranged between the seat 14 and the support 26. The limit stop device 70 comprises an upright 72, which extends upwards from the central base 28 of the support 26. The central upright 72 has an upper head with a support surface 74 facing the lower surface of the seat support panel 64. The upright 72 has a slot 76 elongated in an essentially vertical direction. The slot 76 is engaged by a transverse pin 78 movable along the slot 76. The transverse pin 78 is fixed to two walls 80 projecting downwards, integrally formed with the seat support panel 64. The two walls 80 are arranged laterally on opposite sides of the upright 72. The ends of the transverse pin 78 engage two aligned holes of the walls 80.

Figure 8:
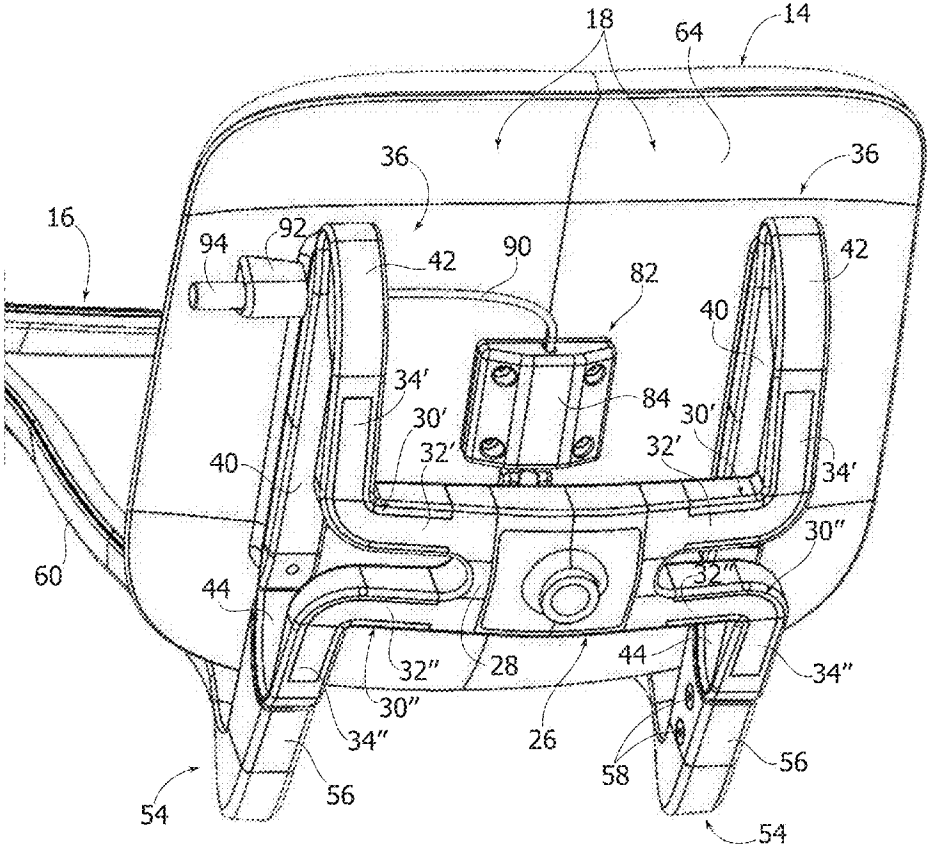
FIG. 8 is a perspective view from below according to the arrow VIII of FIG. 1.
Figure 9:
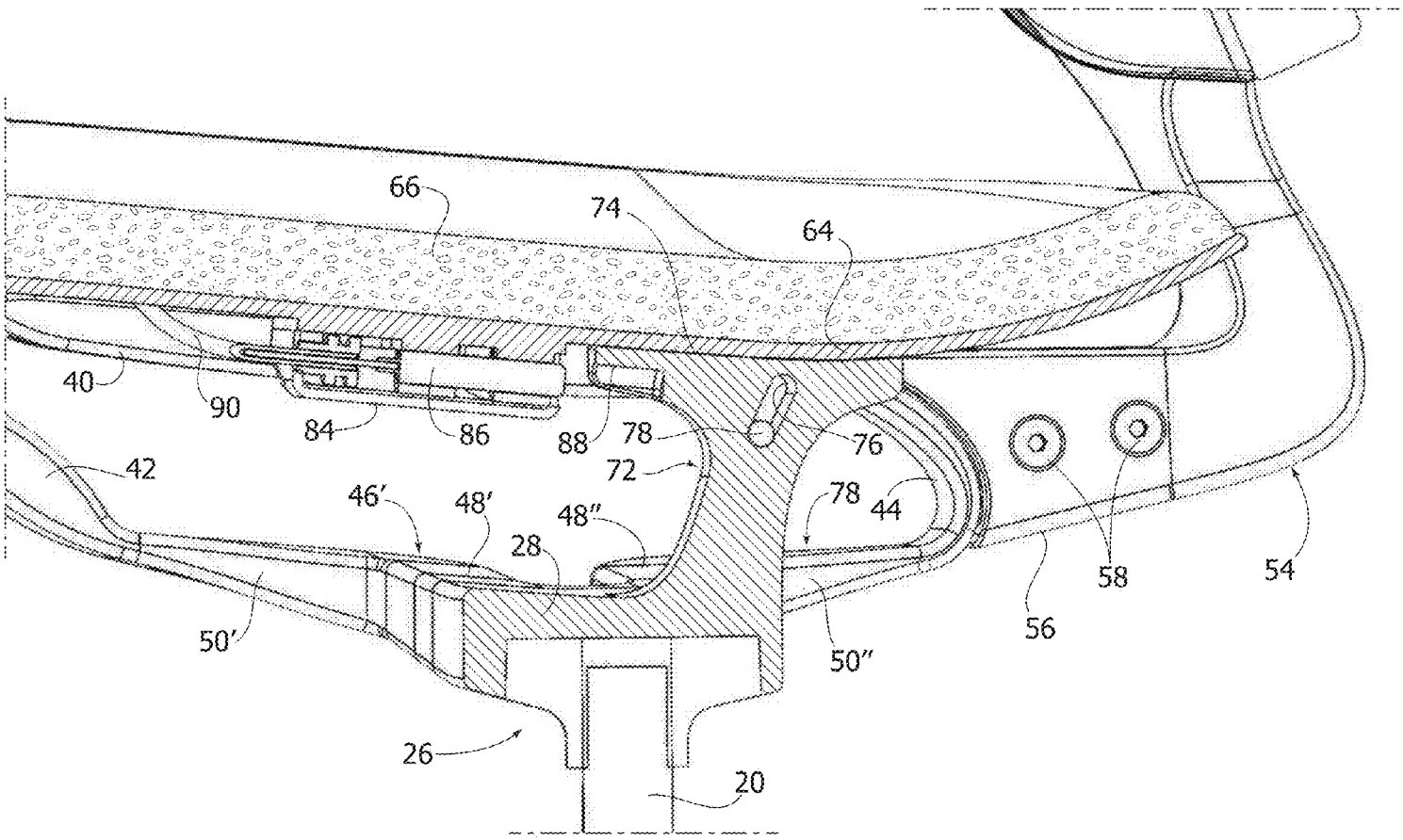
FIGS. 9 and 10 are partial cross-sections according to the line IX-IX of FIG. 1 illustrating a locking device in an unlocked position and a locked position, respectively.
Figure 10:
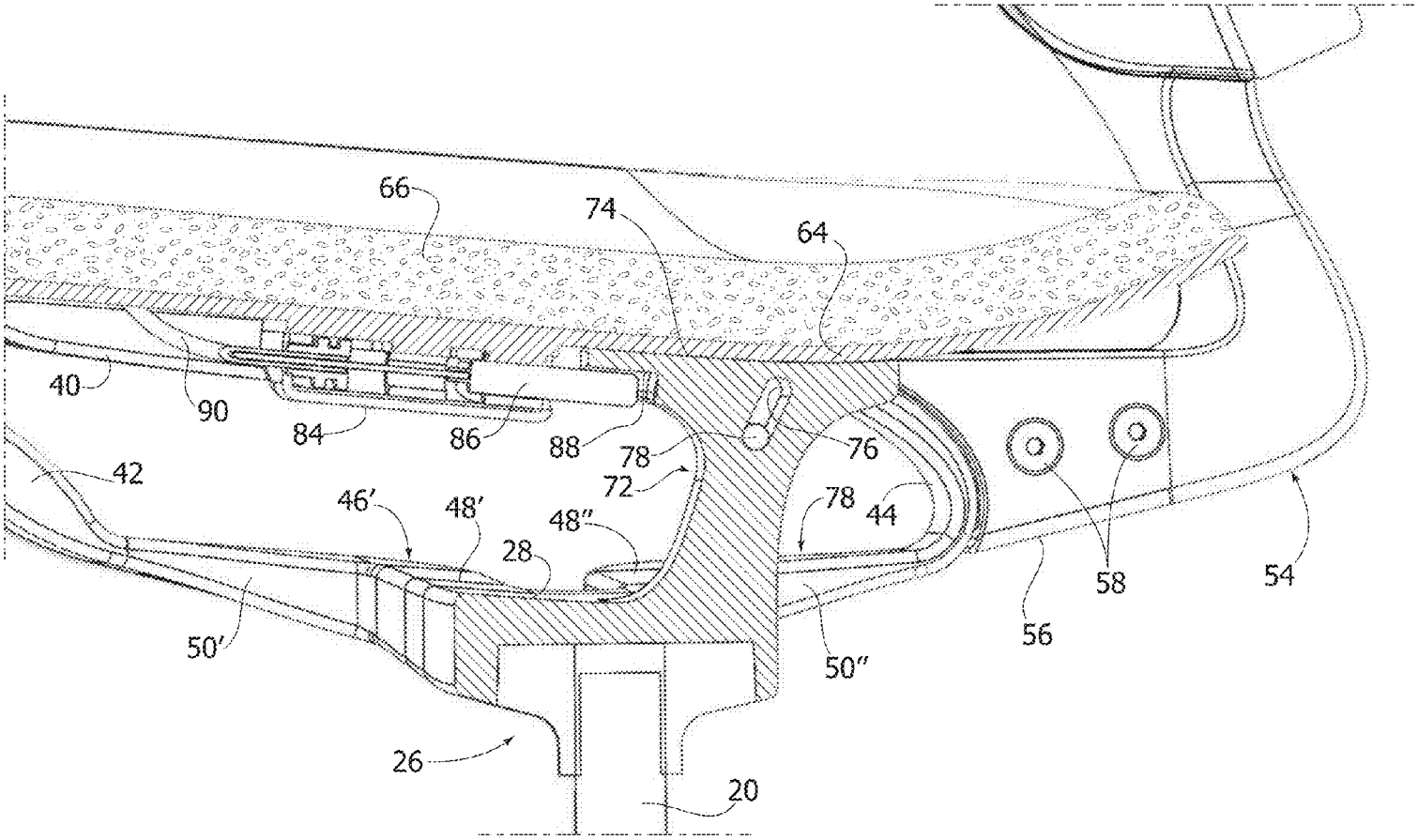

With reference to FIGS. 8-10, the chair 10 comprises a locking device 82 operable by the user to lock or unlock the movement of the seat and backrest. The locking device 82 comprises a housing 84 fixed to the lower surface of the seat support panel 64. A locking pin 86 is movable within the housing 84 in a longitudinal direction, between an unlocked position, illustrated in FIG. 9 and a locked position, illustrated in FIG. 10. The locking pin 86 is connected via a flexible cable 90 to a control device 92, equipped with a button 94 operable by the user. The control device 92 selects the operative position of the locking pin 86 via the flexible cable 90. In the locked position, the locking pin 86 engages a locking seat 88 formed in the lower part of the head of the upright 72. In the unlocked position, the locking pin 86 is disengaged from the locking seat 88.

The operation of the chair according to the present invention is as follows.

Each of the two loop-shaped elastic elements 36, from a kinematic point of view, is equivalent to an articulated parallelogram. The front and rear elastic portions 42, 44 maintain the loop-shaped elastic element 36 in a rest position. In the rest position, the backrest 16 is in an upright position and the seat 14 is in a lowered position. In the rest position, the seat 14 rests on the upper support surface 74 of the upright 72.

Figure 4:
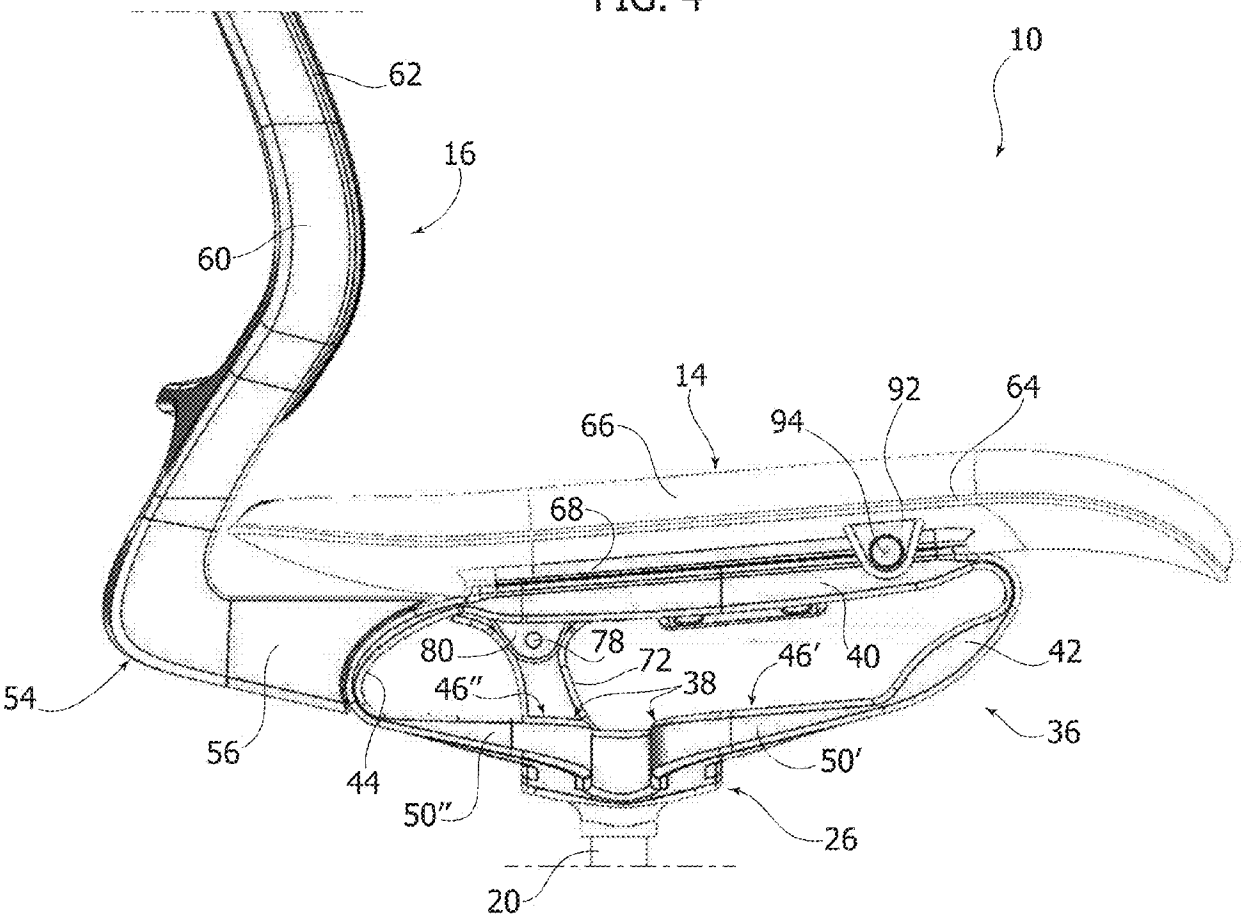
FIG. 4 is a side view illustrating the chair of FIG. 1 in a rest position.
Figure 5:
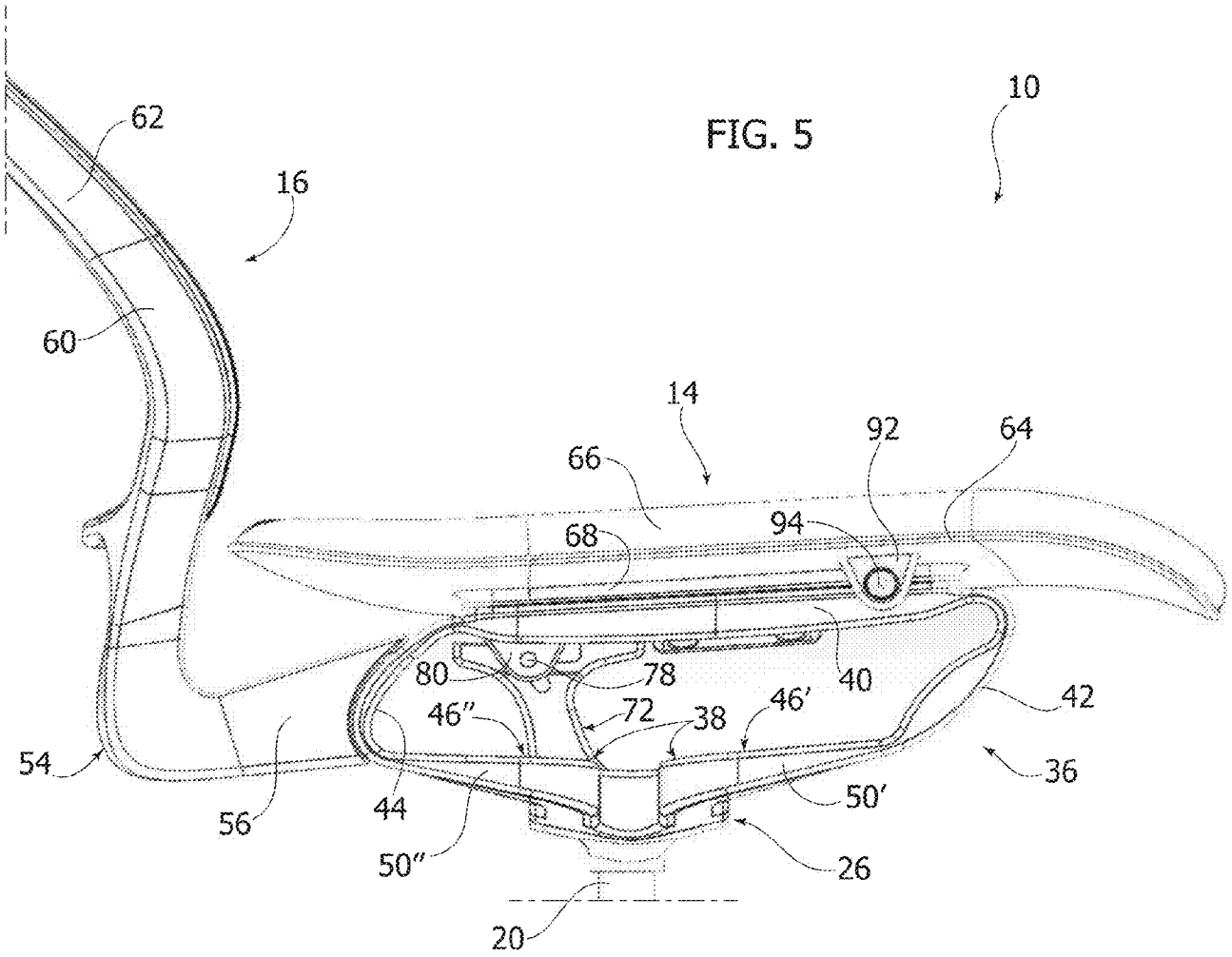
FIG. 5 is a side view analogous to FIG. 4 illustrating the chair in the position of maximum backward inclination of the backrest.

FIG. 4 shows a side view of the resting position of the chair 10. In this condition, the elastic portions 42, 44 of the loop-shaped elastic elements 36 are undeformed. A backward thrust applied by the user against the backrest 16 causes inclination of the backrest 16, as shown in FIG. 5. The backward movement of the backrest 16 elastically deforms the elastic portions 44 of the loop-shaped elastic elements 36. Due to the elastic deformation of the rear elastic portions 44, the upper portions 40 of the loop-shaped elastic elements 36 move upwards and elastically deform the elastic portions 42. Comparing FIGS. 4 and 5, it can be noted that, during the movement from the undeformed position of FIG. 4 to the deformed position of FIG. 5, the upper portion 40 of each loop-shaped elastic element moves upwards, while remaining essentially parallel to itself, as in an articulated parallelogram equipped with two rigid rods hinged to the seat and to the base. The two elastic portions 40, 42 are kinematically equivalent to the two rods of an articulated parallelogram. The upper portion 40 and the lower portion 38 of each loop-shaped elastic element 36 remain undeformed. The only parts of the loop-shaped elastic elements 36 which deform are the elastic portions 42, 44.

As can be seen from FIGS. 4 and 5, the movement of backward inclination of the backrest 16 is synchronized with an upward movement of the seat 14. When the backrest 16 is in the position of maximum backward inclination, the seat 14 is in the highest position, and when the backrest 16 is in the upright position, the seat 14 is in the lowest position. To backwardly-incline the backrest 16, the user must apply a reverse thrust proportional to the weight applied on the seat 14. Therefore, the reaction that the backrest 16 applies to the user's back is proportional to the weight of the user.

As is visible in FIGS. 6 and 7, the limit stop device 70 limits the stroke of the seat 14. In the absence of a reverse thrust on the backrest, the seat 14 rests on the surface 74 of the upright 72. In this position, the seat 14 is in the lowest position. In this position, the transverse pin 78 is at the lower end of the slot 76. In the position of maximum backward inclination of the backrest, the transverse pin 78 comes into abutment against the upper end of the slot 76, as shown in FIG. 7. The limit stop device 70 limits the further upward movement of the seat 14 and, consequently, prevents further backward inclination of the backrest 16.

When the user gets up from the chair 10, the elastic portions 42, 44 return to their undeformed position and return the seat 14 to the lowered position and the backrest 16 to the upright position. The elasticity of the mechanism is provided by the intrinsic elastic properties of the material forming the loop-shaped elastic elements 36. Elastic components are not necessary to provide the return action of the seat and the backrest into the rest position.

The locking device 82 allows locking of the backward movement of the backrest 16 and the upward movement of the seat 14. Indeed, as shown in FIG. 10, when the locking pin 86 engages the seat 88 of the upright 72, the seat 14 is locked with respect to the rigid support 26. Consequently, the upward movement of the seat 14 and the backward-inclined movement of the backrest 16 are prevented.

Figure 11:
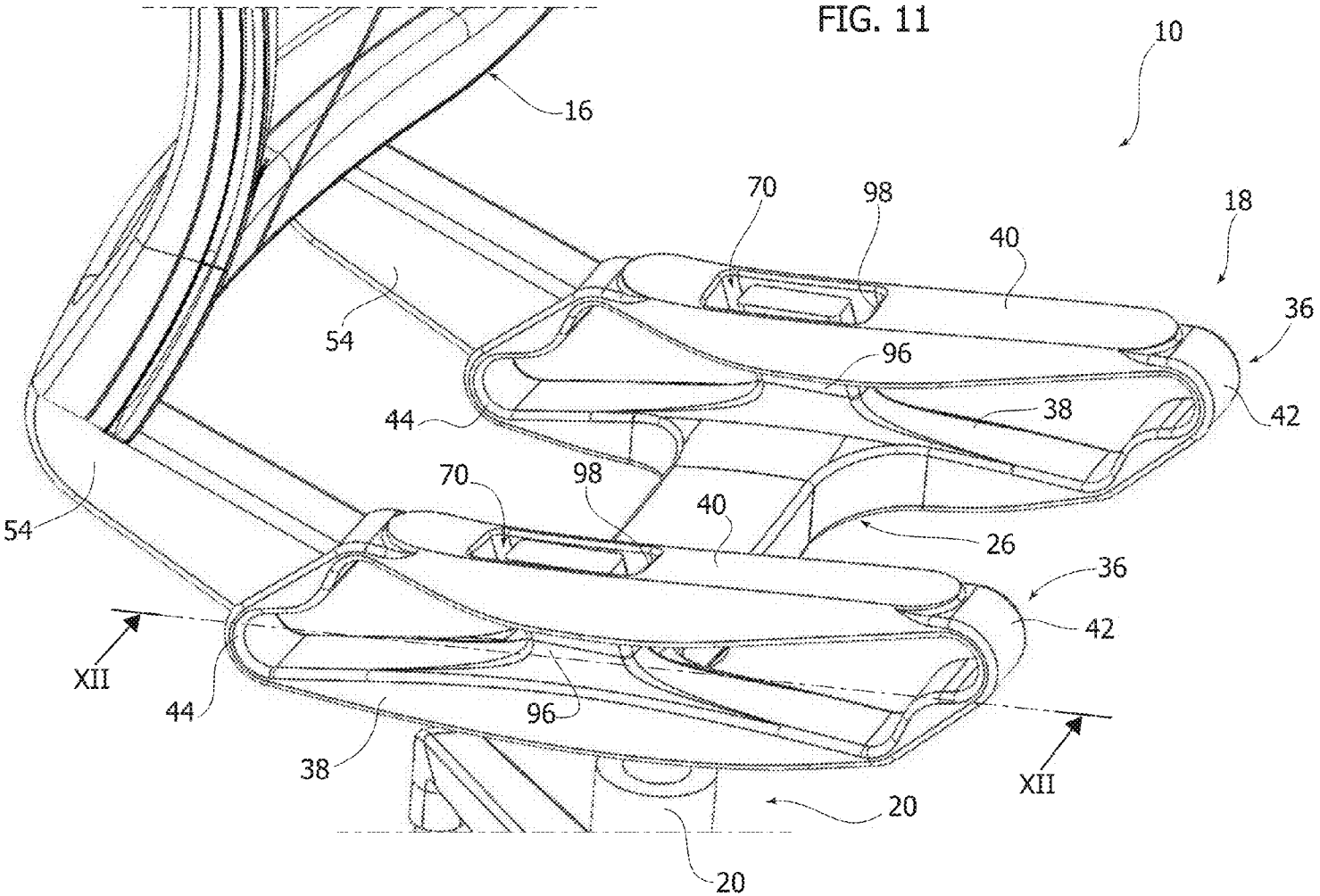
FIG. 11 is a perspective view of a second embodiment of a chair according to the present invention with the seat removed.
Figure 12:
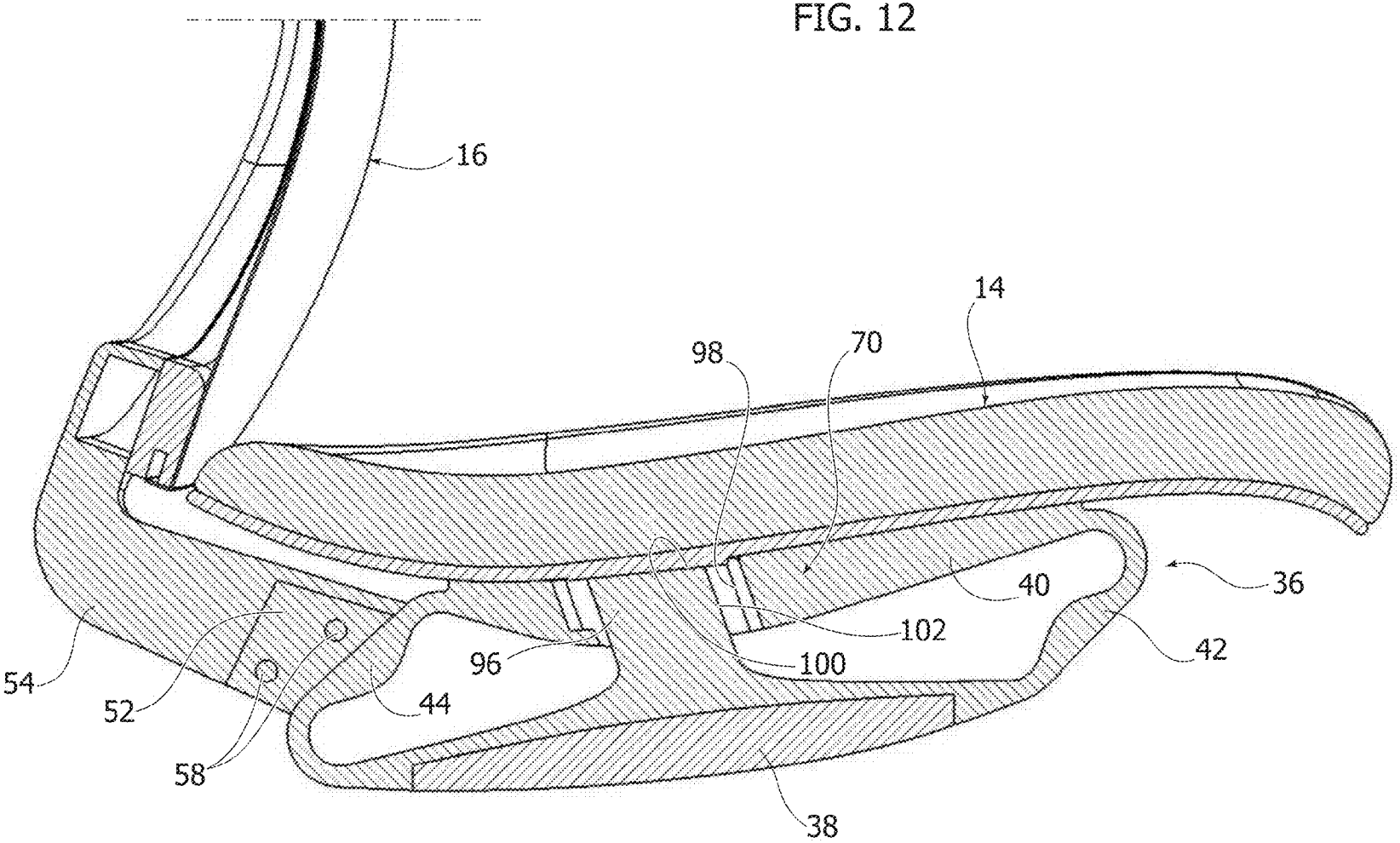
FIGS. 12 and 13 are cross-section taken along the line XII-XII of FIG. 11 in the rest position and in the position of maximum backward inclination, respectively.
Figure 13:
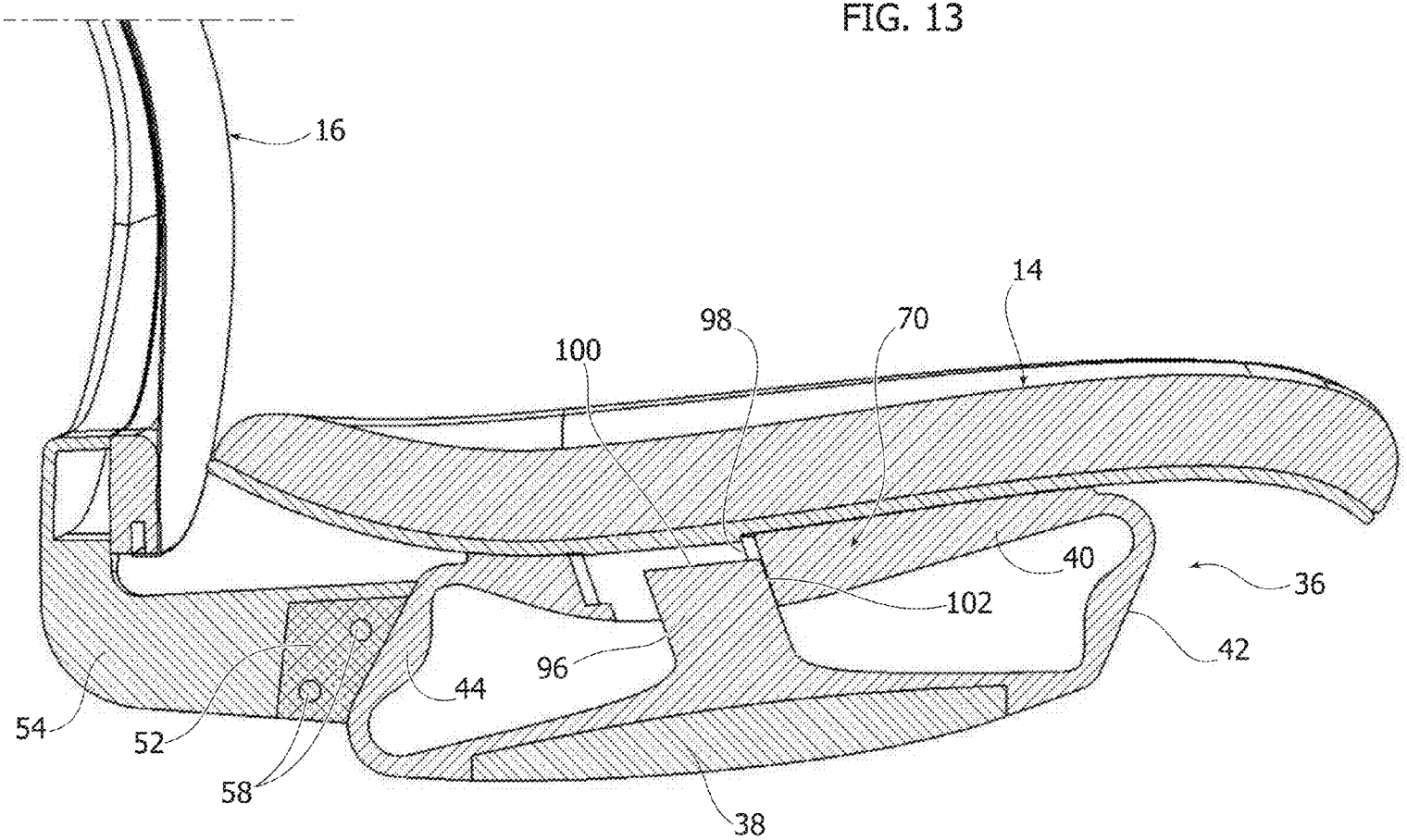

A second embodiment of the limit stop device 70 is shown in FIGS. 11, 12 and 13. In these figures the elements corresponding to those previously described are indicated by the same reference numbers. In the embodiment of FIGS. 11-13 each of the loop-shaped elastic elements 36 of the synchronization mechanism 18 comprises a respective limit stop device 70. Each limit stop device 70 comprises a stop element 96 fixed to or integrally formed with one of the lower portion 38 or upper portion 40 of the respective loop-shaped elastic element 36 and engaging a longitudinal slot 98 formed in the other of the upper portion 40 or lower portion 38. The stop elements 96 extend vertically and engage with longitudinal play the respective slots 98.

In the embodiment shown in the drawings, the stop elements 96 are fixed to or integrally formed with the respective lower portions 38 of the loop-shaped elastic elements 36 and engage respective longitudinal slots 98 formed in the respective upper portions 40. However, the arrangement could be reversed, that is the stop elements 96 could be fixed to or integrally formed with the respective upper portions 40 and engage respective longitudinal slots 98 formed in the lower portions 38.

As described above with reference to the first embodiment, the movements of the backrest 16 and seat 14 are synchronized with each other. When the backrest 16 is in the position of maximum backward inclination the seat 14 is in the highest position and when the backrest 16 is in the upright position the seat 14 is in the lowest position. FIG. 12 shows the rest configuration in which the seat 14 is in the lowest position and the backrest is in the position of maximum forward inclination. In this position the lower surface of the seat 14 rests on the upper surfaces 100 of the stop elements 96, thereby defining a first stop position for the seat/backrest assembly.

As shown in FIG. 13, in the position of maximum backward inclination of the backrest 16, front surfaces 102 of the stop elements 96 abut against front ends of the respective longitudinal slots 98. In this position the stop elements 96 prevent a further backward inclination of the backrest 16 and define a second stop position for the seat/backrest assembly. In the second stop position the seat is in most raised position and it is raised from the upper surfaces 100 of the stop elements 96.

The embodiment of FIGS. 11-13 is advantageous in particular because the loop-shaped elastic elements 38 with the respective stop elements can be integrally formed by injection molding and do not require assembly steps.

Of course, without prejudice to the principle of the invention, the details of construction and the embodiments can be widely varied with respect to those described and illustrated, without thereby departing from the scope of the invention as defined by the claims that follow.

The invention claimed is:

1. A chair comprising:

a base structure comprising a support;

a seat connected to the support via a synchronization mechanism and movable with respect to the base structure between a lowered position and a raised position; and a backrest connected to the synchronization mechanism and movable between an upright position corresponding to the lowered position of the seat and a backward inclined position corresponding to the raised position of the seat, wherein said synchronization mechanism comprises two loop-shaped elastic elements spaced apart in a transverse direction and each comprising a lower portion fixed to the support, an upper portion fixed to the seat, a front elastic portion and a rear elastic portion, which connect the upper portion to the lower portion, wherein the backrest is fixed to the rear elastic portions of said loop-shaped elastic elements, and wherein each of said loop-shaped elastic elements is made from a single piece of molded plastic material.

2. The chair according to claim 1, wherein the backrest comprises two L-shaped lower arms fixed to respective rear elastic portions of said loop-shaped elastic elements.

3. The chair according to claim 2, wherein the rear elastic portion of each of said loop-shaped elastic elements has a rear projection fixed to a respective L-shaped lower arm.

4. The chair according to claim 1, wherein the lower portion of each of said loop-shaped elastic elements comprises two fastening elements fixed to respective side arms of said support.

5. The chair according to claim 4, wherein each of said fastening elements comprises a transverse portion and a longitudinal portion, which are coupled, respectively, with a transverse portion and with a longitudinal portion of the respective side arm.

6. The chair according to claim 1, wherein the upper portion of each of said loop-shaped elastic elements has the shape of a longitudinal rectilinear beam fixed to a corresponding longitudinal rib of the seat.

7. The chair according to claim 1, further comprising a limit stop device operatively interposed between said support and said seat, said limit stop device comprising an upright projecting upwardly from said support and having a slot engaged by a transverse pin fixed to said seat.

8. The chair according to claim 1, further comprising a locking device comprising a housing fixed to the seat, a locking pin movable relative to the housing between a locking position and an unlocking position and cooperating with a fixed locking seat, the locking device further comprising a control device connected to said locking pin via a flexible cable.

9. The chair according to claim 1, wherein each of the loop-shaped elastic elements of the synchronization mechanism comprises a respective limit stop device that limits the synchronized movement of the seat/backrest assembly between a first and a second position.

10. The chair according to claim 9, wherein each limit stop device comprises a stop element fixed to or integrally formed with the lower portion of the respective loop-shaped elastic element and engaging a longitudinal slot formed in the upper portion of the respective loop-shaped elastic element.

11. The chair according to claim 10, wherein the stop elements extend vertically and engage with longitudinal play the respective slots.

12. The chair according to claim 10, wherein each stop element has an upper surface on which the seat abuts in its lowermost position.

13. The chair according to claim 10, wherein each stop element has a front surface that abuts against a front end of the respective longitudinal slot in the position of maximum backward inclination of the backrest.

* * * * *